US009193056B2

(12) United States Patent
Lin

(10) Patent No.: US 9,193,056 B2
(45) Date of Patent: Nov. 24, 2015

(54) PNEUMATIC SPANNER STRUCTURE

(71) Applicant: Chun Yu Lin, Taichung (TW)

(72) Inventor: Chun Yu Lin, Taichung (TW)

( * ) Notice: Subject to any disclaimer, the term of this patent is extended or adjusted under 35 U.S.C. 154(b) by 466 days.

(21) Appl. No.: 13/685,519

(22) Filed: Nov. 26, 2012

(65) Prior Publication Data

US 2013/0233585 A1 Sep. 12, 2013

(30) Foreign Application Priority Data

Mar. 12, 2012 (TW) ..... 101204393 A

(51) Int. Cl.

| | |
|---|---|
| ***E21B 3/00*** | (2006.01) |
| ***E21B 17/22*** | (2006.01) |
| ***E21B 19/16*** | (2006.01) |
| ***E21B 19/18*** | (2006.01) |
| ***B25F 5/00*** | (2006.01) |
| ***B25B 21/00*** | (2006.01) |
| ***B25B 21/02*** | (2006.01) |

(52) U.S. Cl.
CPC ..... *B25F 5/005* (2013.01); *B25B 21/004* (2013.01); *B25B 21/02* (2013.01)

(58) Field of Classification Search
CPC ..... B25F 5/005
USPC ..... 173/216, 213
See application file for complete search history.

(56) References Cited

U.S. PATENT DOCUMENTS

| | | | | |
|---|---|---|---|---|
| 3,605,914 | A * | 9/1971 | Kramer | 173/93 |
| 3,661,217 | A * | 5/1972 | Maurer | 173/93.5 |
| 5,622,230 | A * | 4/1997 | Giardino et al. | 173/93.5 |
| 5,975,218 | A * | 11/1999 | Liau | 173/216 |
| 6,655,473 | B1 * | 12/2003 | Chi | 173/216 |
| 7,147,063 | B2 * | 12/2006 | Chen | 173/93.5 |
| 7,607,492 | B2 * | 10/2009 | Seith et al. | 173/176 |
| 7,926,321 | B2 * | 4/2011 | Rollins et al. | 72/453.15 |
| 8,695,725 | B2 * | 4/2014 | Lau et al. | 173/170 |
| 9,016,395 | B2 * | 4/2015 | Scott | 173/98 |
| 2006/0131041 | A1 * | 6/2006 | Hsieh | 173/104 |
| 2008/0289451 | A1 * | 11/2008 | Subramanian | 81/57.29 |
| 2012/0247797 | A1 * | 10/2012 | Wei | 173/122 |
| 2013/0043053 | A1 * | 2/2013 | Malorni et al. | 173/216 |
| 2013/0112449 | A1 * | 5/2013 | Lu | 173/126 |

* cited by examiner

*Primary Examiner* — Robert Long
(74) *Attorney, Agent, or Firm* — Ming Chow; Sinorica, LLC

(57) ABSTRACT

A pneumatic spanner structure includes a head body, a link bevel gear unit, a hit unit and a driving handle. A driving motor axle portion at an open end of the driving handle drives a motor link bevel gear post and a hit unit link bevel gear plate of the link bevel gear unit. The hit unit link bevel gear plate links the hit unit. The link bevel gear unit enhances and transmits the force to the hit unit. The hit unit applies the acting force on a workpiece. The hit unit doesn't need a buffer space for actuation and the force is indirect. The link bevel gear unit is a deceleration device to extend the service life of the whole structure. The output force is more powerful than the prior art, providing a stable and compact structure.

1 Claim, 6 Drawing Sheets

PNEUMATIC SPANNER STRUCTURE

The current application claims a foreign priority to the patent application of Taiwan No. 101204393 filed on Mar. 12, 2012.

BACKGROUND OF THE INVENTION

1. Field of the Invention

The present invention relates to a pneumatic spanner structure, and more particularly, to a pneumatic spanner structure for a pneumatic tool.

2. Description of the Prior Art

A conventional pneumatic spanner, as shown in FIG. 6, comprises a hit unit (50) to drive a gear post (51). The gear post (51) drives a bevel gear plate (52) to link a spanner axle (53). However, the conventional pneumatic spanner has the following shortcomings.

1. Unstable structure: The hit unit drives the gear post. The gear post drives the bevel gear plate to link the spanner axle. The force is direct applied to the gear post and the gear plate to wear and tear the teeth of the gear post and the gear plate. Through the hit unit to drive the gear, the impact of the hit unit centralizes the press on the gear post and the gear plate to damage the gear post and the gear plate so the structure is unstable.

2. Not compact structure: The hit unit drives the gear post. The gear post drives the bevel gear plate to link the spanner axle. This structure needs larger buffer space to consume the efficiency of the hit unit. The force cannot be transmitted efficiently to form weak energy so the structure is not compact.

Accordingly, the inventor of the present invention has devoted himself based on his many years of practical experiences to solve this problem.

SUMMARY OF THE INVENTION

The primary object of the present invention is to provide a pneumatic spanner structure which comprises a head body, a link bevel gear unit, a hit unit and a driving handle. A connection positioning hole of the axle portion of a motor link bevel gear post is adapted for connection of a driving motor axle portion at the open end of the driving handle. A guide post with a second rotation ring of a hit unit link bevel gear plate is positioned in a first positioning trough of an accommodation head seat portion of a head body. A link axle portion of the hit unit is engaged in an engaging hole of a second positioning trough of the hit unit link bevel gear plate. A head portion extends out of a lid of the accommodation head seat portion of the head body. The driving motor axle portion at the open end of the driving handle drives the motor link bevel gear post and the hit unit link bevel gear plate of the link bevel gear unit. The hit unit link bevel gear plate links the hit unit. The link bevel gear unit enhances and transmits the force to the hit unit. The hit unit applies the acting force on a workpiece. The hit unit doesn't need a buffer space for actuation and the force is indirect. The link bevel gear unit is a deceleration device to extend the service life of the whole structure. The output force is more powerful than the prior art, providing a stable and compact structure.

DETAILED DESCRIPTION OF THE PREFERRED EMBODIMENTS

Embodiments of the present invention will now be described, by way of example only, with reference to the accompanying drawings.

Figure 1:
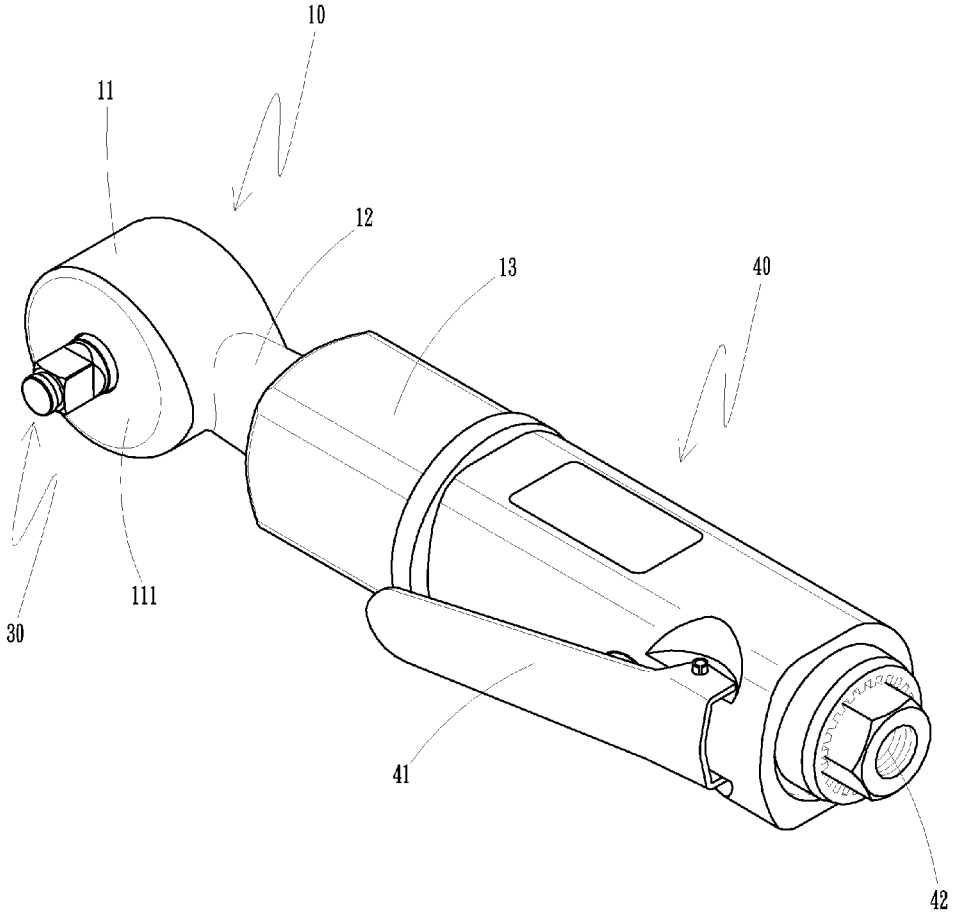
FIG. 1 is a perspective view of the present invention.
Figure 2:
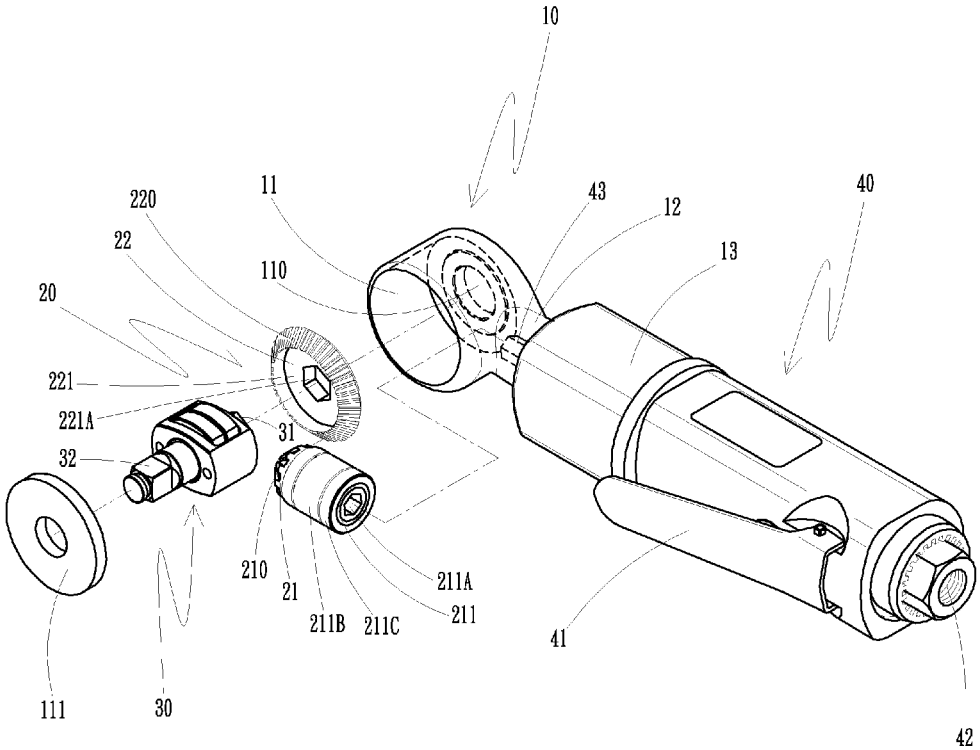
FIG. 2 is an exploded view of the present invention.
Figure 3:
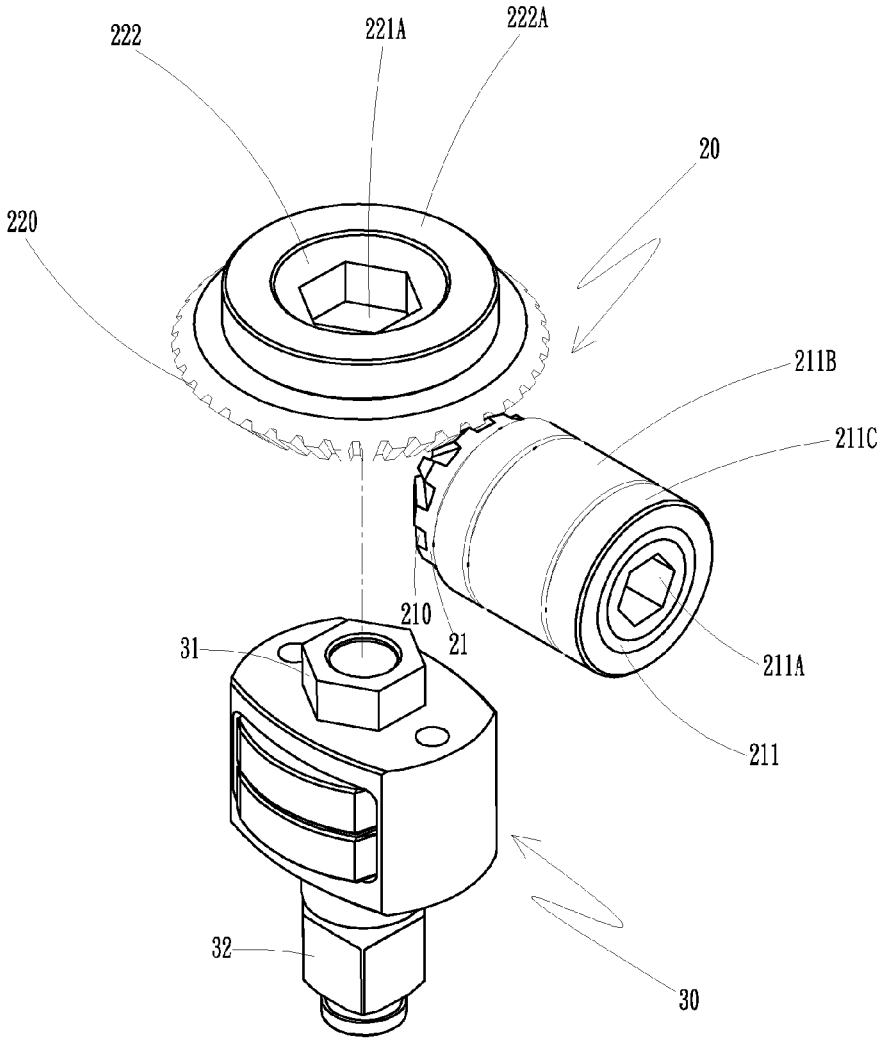
FIG. 3 is a partial perspective view of the present invention.
Figure 4:
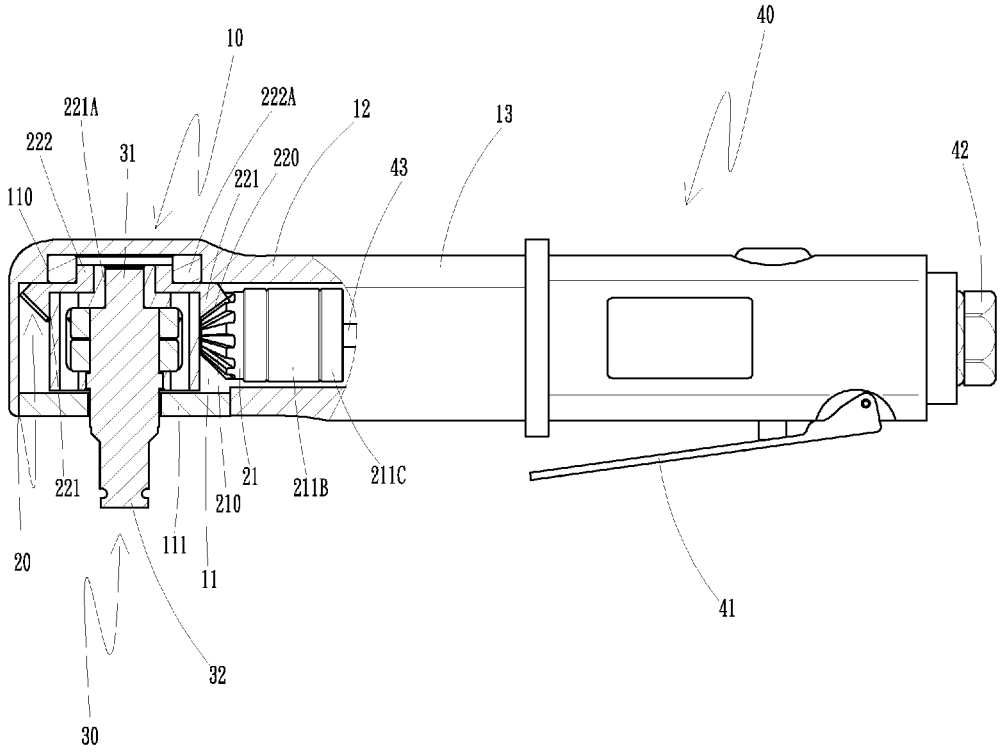
FIG. 4 is a partial sectional view of the present invention.

FIG. 1 is a perspective view of the present invention. FIG. 2 is an exploded view of the present invention. FIG. 3 is a partial perspective view of the present invention. FIG. 4 is a partial sectional view of the present invention. As shown in FIG. 1 to FIG. 4, the pneumatic spanner structure of the present invention comprises a head body (10), a link bevel gear unit (20), a hit unit (30) and a driving handle (40).

The head body (10) comprises an accommodation head seat portion (11), a hollow neck portion (12) and an accommodation connection seat portion (13). The accommodation head seat portion (11), the hollow neck portion (12) and the accommodation connection seat portion (13) communicate with each other. The accommodation head seat portion (11) has a first positioning trough (110) therein. The accommodation head seat portion (11) is covered with a lid (111).

The link bevel gear unit (20) comprises a motor link bevel gear post (21) and a hit unit link bevel gear plate (22). The motor link bevel gear post (21) has a mesh gear portion (210) and an axle portion (211). The axle portion (211) has a connection positioning hole (211A) therein. An axle sleeve (211B) is fitted on a central section of the axle portion (211). A pair of first rotation ring (211C) is fitted on the axle portion (211) and respectively located at two ends of the axle sleeve (211B). The hit unit link bevel gear plate (22) comprises a mesh bevel gear (220) at one side thereof. The mesh bevel gear (220) has a second positioning trough (221) at an inner side thereof. The hit unit link bevel gear plate (22) comprises a guide post (222) at another side thereof. The second positioning trough (221) has an engaging hole (221A). A second rotation ring (222A) is fitted on the guide post (222). The mesh bevel gear (210) of the motor link bevel gear post (21) meshes with the mesh bevel gear (220) of the hit unit link bevel gear plate (22). The guide post (222) with the second rotation ring (222A) is positioned in the first positioning trough (110) of the accommodation head seat portion (11) of the head body (10).

The hit unit (30) comprises a link axle portion (31) and a head portion (32). The link axle portion (31) is engaged in the engaging hole (221A) of the second positioning trough (221) of the hit unit link bevel gear plate (22). The head portion (32) extends out of the lid (111) of the accommodation head seat portion (11) of the head body (10).

The driving handle (40) comprises a control press portion (41) and an air guide pipe connection portion (42). The driving handle (40) has an open end provided with a driving motor axle portion (43). The driving motor axle portion (43) is connected to the connection positioning hole (211A) of the axle portion (211) of the motor link bevel gear post (21).

Figure 5:
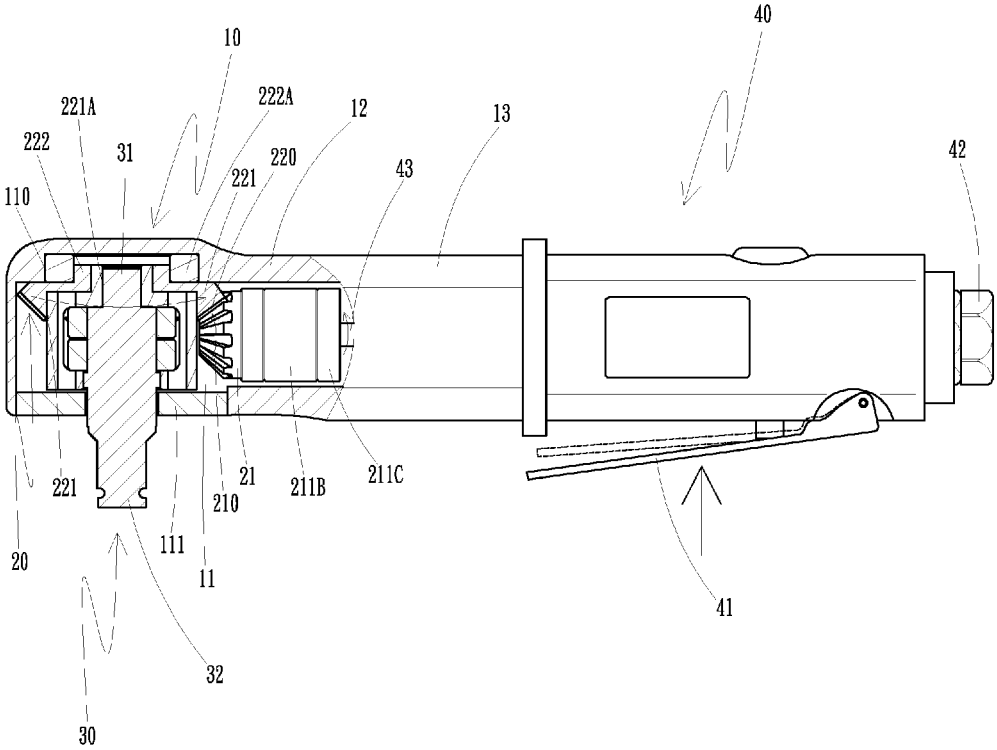
FIG. 5 is a partial sectional view of the present invention in an operating state.
Figure 6:
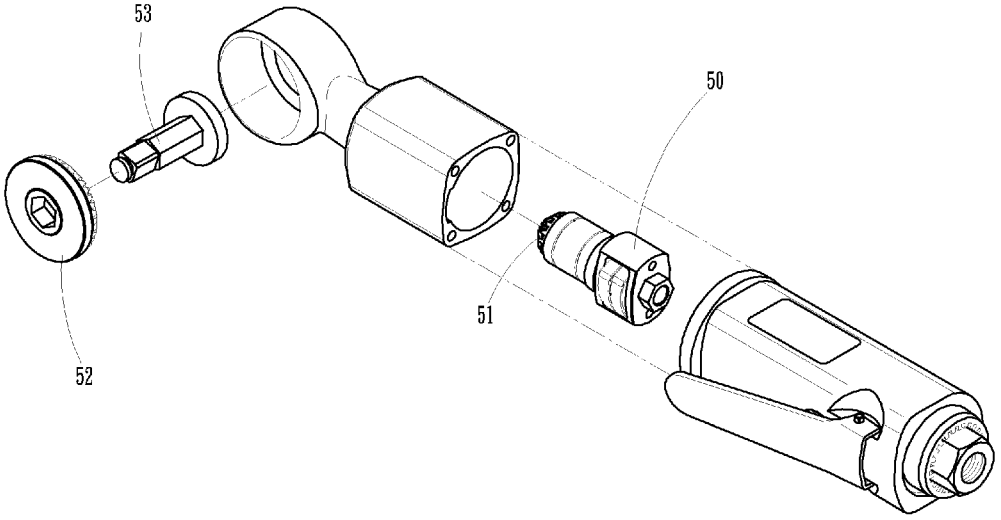
PRIOR ART FIG.6
FIG. 6 is an exploded view of a conventional pneumatic spanner.

As shown in FIG. 2 and FIG. 5, the connection positioning hole (211A) of the axle portion (211) of the motor link bevel gear post (21) is adapted for connection of the driving motor axle portion (43) at the open end of the driving handle (40). The guide post (222) with the second rotation ring (222A) of the hit unit link bevel gear plate (22) is positioned in the first positioning trough (110) of the accommodation head seat portion (11) of the head body (10). The link axle portion (31) of the hit unit (30) is engaged in the engaging hole (221A) of the second positioning trough (221) of the hit unit link bevel gear plate (22). The head portion (32) extends out of the lid (111) of the accommodation head seat portion (11) of the head body (10). The driving motor axle portion (43) at the open end of the driving handle (40) drives the motor link bevel gear post (21) and the hit unit link bevel gear plate (22) of the link bevel gear unit (20). The hit unit link bevel gear plate (22) links the hit unit (30). The link bevel gear unit (20) enhances and transmits the force to the hit unit (30). The hit unit (30) applies the acting force on a workpiece. The hit unit (30) doesn't need a buffer space for actuation and the force is indirect. The link bevel gear unit (20) is a deceleration device to extend the service life of the whole structure. The output force is more powerful than the prior art, providing a stable and compact structure.

The present invention has the following advantages.

1. Stable structure: The driving motor axle portion at the open end of the driving handle drives the motor link bevel gear post and the hit unit link bevel gear plate of the link bevel gear unit. The hit unit link bevel gear plate links the hit unit. The hit unit doesn't need a buffer space for actuation and the force is indirect so the structure is stable.

2. Compact structure: The driving motor axle portion at the open end of the driving handle drives the motor link bevel gear post and the hit unit link bevel gear plate of the link bevel gear unit. The hit unit link bevel gear plate links the hit unit. The hit unit doesn't need a buffer space for actuation so the whole structure and assembly is compact.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A pneumatic spanner structure, comprising:

a head body, the head body comprising an accommodation head seat portion, a hollow neck portion and an accommodation connection seat portion, the accommodation head seat portion, the hollow neck portion and the accommodation connection seat portion communicating with each other, the accommodation head seat portion being covered with a lid;

a link bevel gear unit, the link bevel gear unit comprising a motor link bevel gear post and a hit unit link bevel gear plate, the motor link bevel gear post having a mesh gear portion and an axle portion, the axle portion having a connection positioning hole therein, the hit unit link bevel gear plate comprising a mesh bevel gear at one side thereof, the mesh bevel gear having a second positioning trough at an inner side thereof, the hit unit link bevel gear plate comprising a guide post at another side thereof, the second positioning trough having an engaging hole, the mesh bevel gear of the motor link bevel gear post meshing with the mesh bevel gear of the hit unit link bevel gear plate, the guide post being positioned in the first positioning trough of the accommodation head seat portion of the head body;

a hit unit, the hit unit comprising a link axle portion and a head portion, the link axle portion being engaged in the engaging hole of the second positioning trough of the hit unit link bevel gear plate, the head portion extending out of the lid of the accommodation head seat portion of the head body; and a driving handle, the driving handle comprising a control press portion and an air guide pipe connection portion, the driving handle having an open end provided with a driving motor axle portion, the driving motor axle portion being connected to the connection positioning hole of the axle portion of the motor link bevel gear post;

the accommodation head seat portion has a first positioning trough therein, a second rotation ring is fitted on the guide post of the hit unit link bevel gear plate of the link bevel gear unit, and the guide post with the second rotation ring is positioned in the first positioning trough of the accommodation head seat portion of the head body; and an axle sleeve is fitted on a central section of the axle portion of the motor link bevel gear post of the link bevel gear unit, and a pair of first rotation ring is fitted on the axle portion and respectively located at two ends of the axle sleeve.

* * * * *